US008490349B2

(12) United States Patent
Lutzner et al.

(10) Patent No.: US 8,490,349 B2
(45) Date of Patent: Jul. 23, 2013

(54) IN-FLOOR TRACK ASSEMBLY FOR SLIDING PANELS WITH BUILT-IN DRAINAGE SYSTEM

(76) Inventors: Jeffrey Lutzner, Philadelphia, PA (US); Benjamin P. Carter, Lake Mary, FL (US)

( * ) Notice: Subject to any disclaimer, the term of this patent is extended or adjusted under 35 U.S.C. 154(b) by 190 days.

(21) Appl. No.: 13/117,193

(22) Filed: May 27, 2011
(Under 37 CFR 1.47)

(65) Prior Publication Data

US 2012/0297712 A1 Nov. 29, 2012

(51) Int. Cl.
*E06B 7/14* (2006.01)

(52) U.S. Cl.
USPC ..... 52/207; 52/204.51

(58) Field of Classification Search
CPC ..... E05D 15/0686; E05D 15/0656; E06B 7/14; E06B 3/4636
USPC ..... 52/302.1, 207, 204.51; 16/90, 95 R, 16/96 R, 102; 160/201
See application file for complete search history.

(56) References Cited

U.S. PATENT DOCUMENTS 2,273,877 A * 2/1942 Kammerer ..... 49/437
2,913,046 A * 11/1959 Sharp et al. ..... 160/91
3,000,046 A * 9/1961 Foltz ..... 16/90
3,205,529 A * 9/1965 Vintan ..... 16/90
5,297,367 A * 3/1994 Sainz ..... 52/12
5,341,600 A * 8/1994 Heppner ..... 49/471
5,535,554 A * 7/1996 Harris Jr. ..... 52/12
6,479,265 B1 * 11/2002 Napper et al. ..... 435/188.5
6,792,651 B2 9/2004 Weiland et al.
7,007,343 B2 3/2006 Weiland et al.
2006/0096061 A1 * 5/2006 Weiland et al. ..... 16/102

OTHER PUBLICATIONS

Panda Windows & Doors, Product Description "Lift & Slide Alum. & Wood" (undated).

* cited by examiner

*Primary Examiner* — Branon Painter
(74) *Attorney, Agent, or Firm* — Caesar, Rivise, Bernstein, Cohen & Pokotilow, Ltd.

(57) ABSTRACT

An in-floor track assembly with a built-in drainage system for sliding doors is disclosed. The assembly includes a drainage pan having a generally rectangular floor and integral walls that extend upwardly at opposite ends of the floor. A track extends laterally from a wall of the drainage pan and then extends upwardly and slightly above the level of a finished floor in a building. The track is arranged to engage wheels of a vertically-oriented panel such as a sliding door and support motion of the panel along the track. An upright splashguard is secured in spaced-apart relation to the drainage pan floor. The splashguard is located parallel to and spaced slightly apart from the track. The splashguard extends upwardly to be level with the finished floor. Together, the track and the splashguard form a drainage passageway therebetween to permit moisture to be directed to the drainage pan. A catch basin is mounted under the drainage pan to collect moisture from the drainage pan and return it to the exterior through a drainage tube.

2 Claims, 4 Drawing Sheets

IN-FLOOR TRACK ASSEMBLY FOR SLIDING PANELS WITH BUILT-IN DRAINAGE SYSTEM

CROSS-REFERENCE TO RELATED APPLICATIONS (Not Applicable)

BACKGROUND OF THE INVENTION

Field of Invention

Various types of access doors for buildings are known in the prior art. One type of access door is a door having a fixed panel and one or more sliding panels mounted on a track assembly for reciprocal lateral movement relative to the fixed panel. The fixed or sliding panels may be glass or solid panels that slide on a single track or on separate, but closely parallel tracks of the track assembly. Sliding doors are particularly utilizable in residential dwellings and they are commonly used to provide egress to a deck, patio, etc. Problems arise when such sliding doors are utilized in a home. Sleet, rain, or snow hitting the exterior surface of the sliding panels runs down the panel surface and collects at the bottom of the panel and in the track assembly on which the panels are mounted for sliding movement. Once the moisture reaches the track assembly, problems can develop due to water flowing from the track assembly into the interior or back out to the exterior of a residential dwelling.

For example, water can flow under the sliding panel and into a room wetting carpets or rugs that can become stained or cause bad odors. Such water can stain an interior cement floor or cause interior wood flooring to deteriorate. Such water can loosen or dissolve glue holding down other floor coverings used in residential interiors such as linoleum, parquet, and vinyl squares.

Some door systems where sliding panels are mounted on track assemblies are designed with weep drainage systems that include drainage holes on the track assembly which enables water to drain to the exterior. However, proper maintenance of the drainage holes, including keeping them free of any dirt or debris, is required to assure proper drainage. Alternatively, to keep rain water from finding its way inside, one drainage system employs a channel and a series of collection pans mounted thereunder to collect moisture and re-direct it to the exterior. However, it is unclear whether these prior art drainage systems would be provide sufficient drainage in geographic zones that experience hurricane force winds and increased volumes of rain. Accordingly, it is desirable to provide a system that captures substantial volumes of water flowing into the track assembly and convey it back to the exterior from the track assembly before the problems described above begin to develop.

BRIEF SUMMARY OF THE INVENTION

An in-floor track assembly with a built-in drainage system for sliding doors is disclosed. The assembly includes a drainage pan having a generally rectangular floor and integral walls that extend upwardly at opposite ends of the floor. A track extends laterally from a wall of the drainage pan and then extends upwardly and slightly above the level of a finished floor in a building. The track is arranged to engage wheels of a vertically-oriented panel such as a sliding door and support motion of the panel along the track. An upright splashguard is secured in spaced-apart relation to the drainage pan floor. The splashguard is located parallel to and spaced slightly apart from the track. The splashguard extends upwardly to be level with the finished floor. Together, the track and the splashguard form a drainage passageway therebetween to permit moisture to be directed to the drainage pan. A catch basin is mounted under the drainage pan to collect moisture from the drainage pan and return it to the exterior through a drainage tube.

BRIEF DESCRIPTION OF THE DRAWINGS

The invention will be described in conjunction with the following drawings in which like reference numerals designate like elements and wherein.

DETAILED DESCRIPTION OF THE INVENTION

Figure 1:
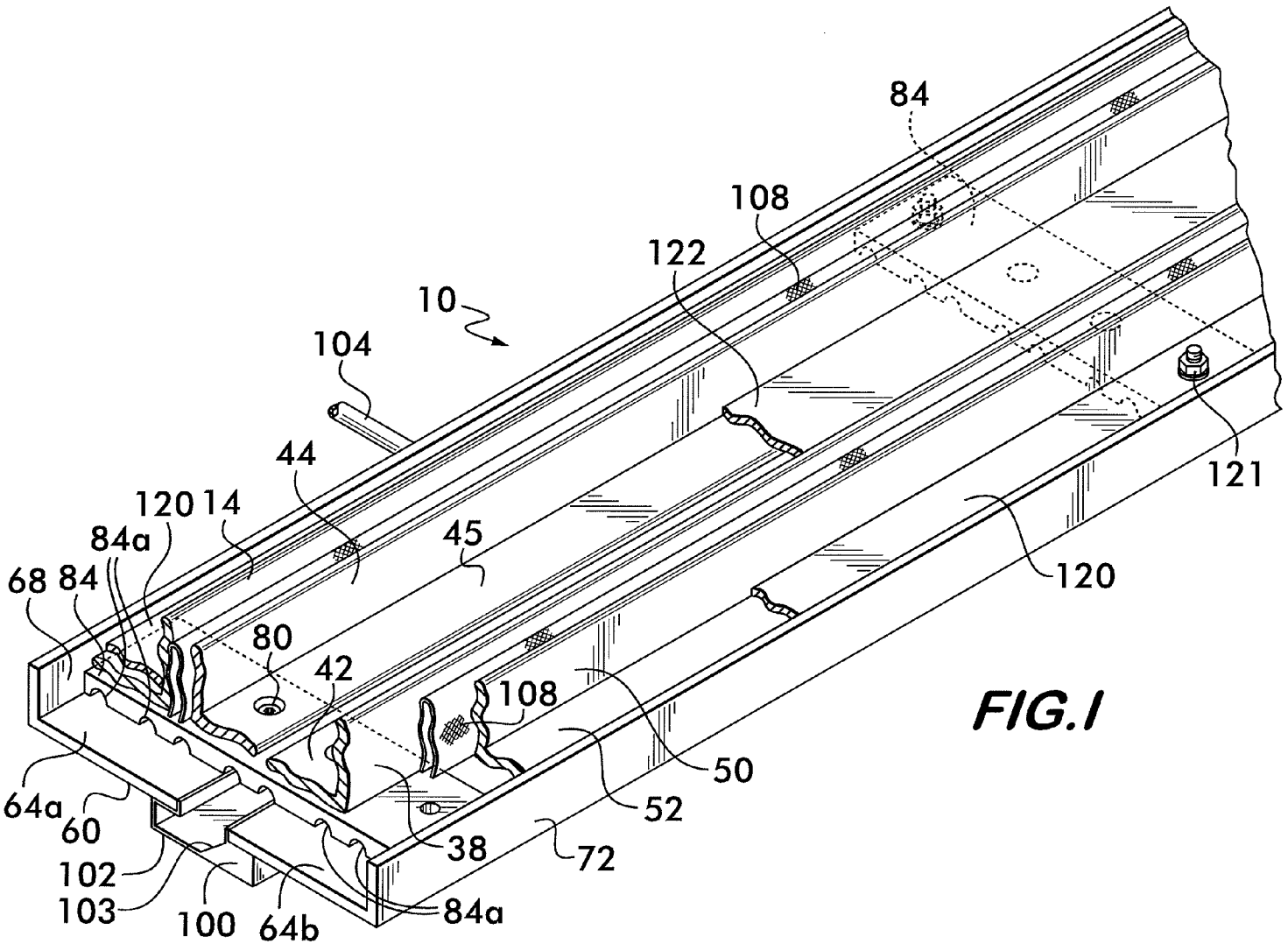
FIG. 1 is a perspective view of a portion of the track assembly of the present invention.
Figure 2:
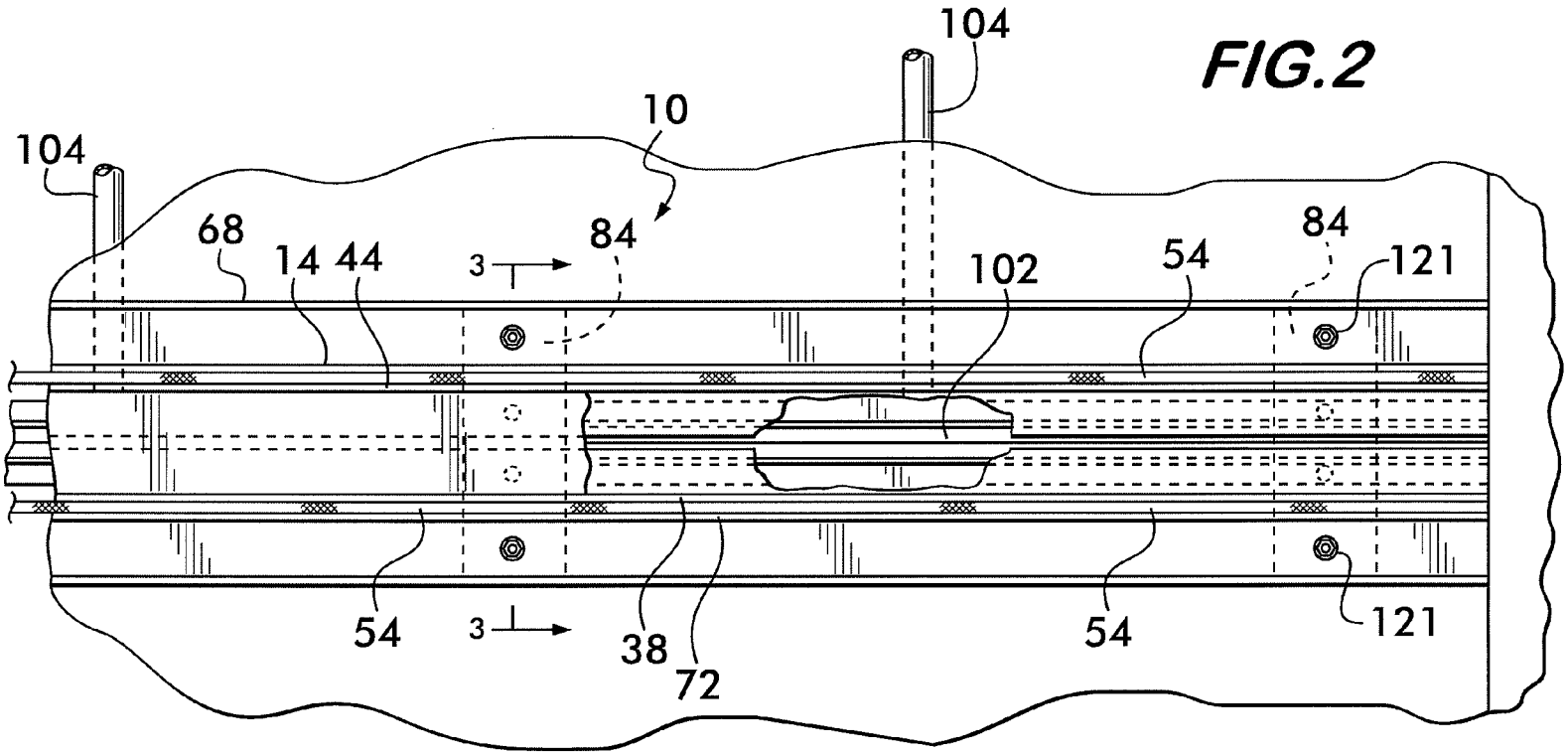
FIG. 2 is a top view of the track assembly of the present invention with cut away views to illustrate the catch basin and other details.
Figure 3:
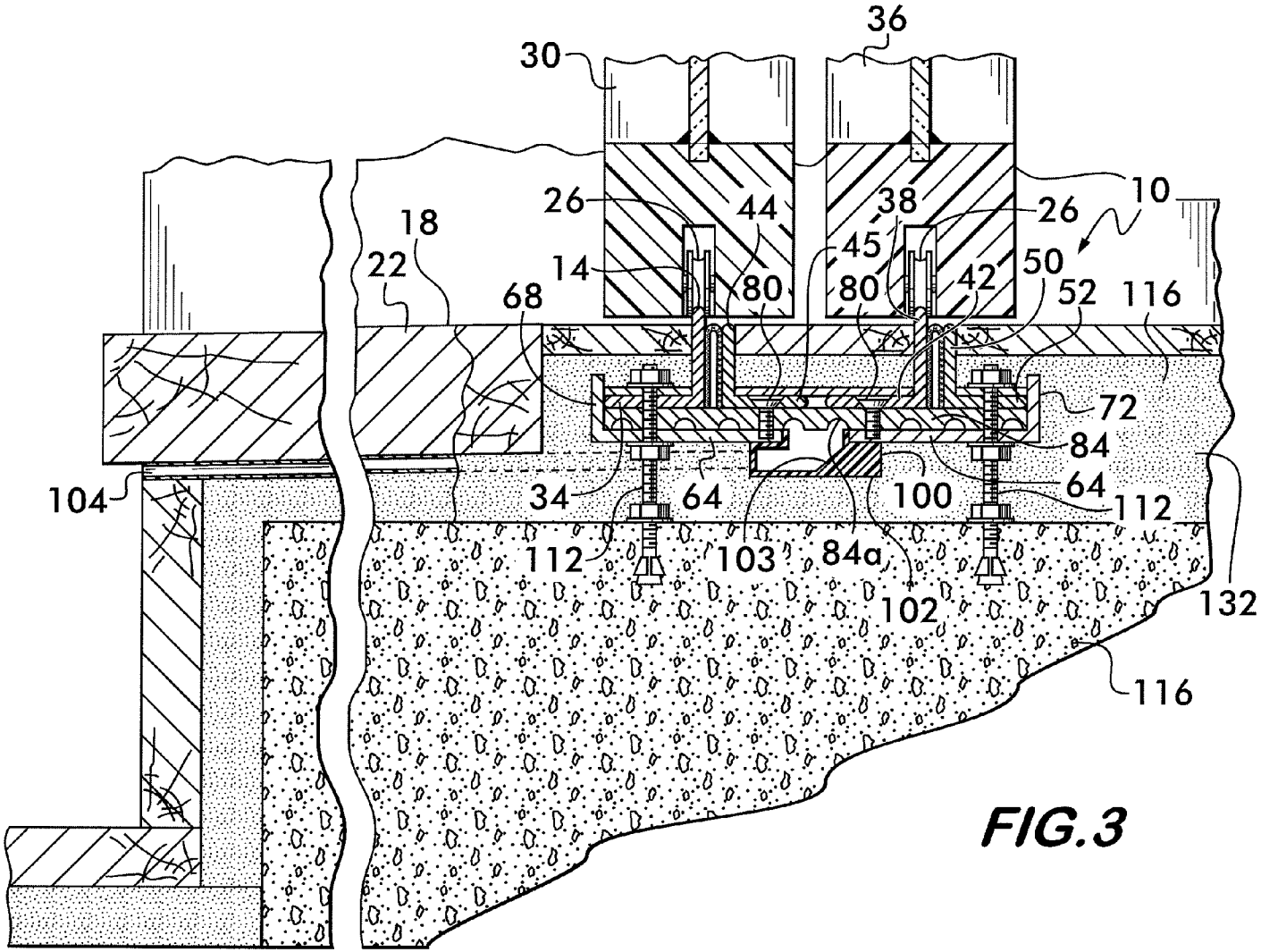
FIG. 3 is a cross-sectional view taken along line 3-3 of FIG. 2; and, FIG. 4 is a cross sectional elevational view of the track assembly of the present invention.
Figure 4:
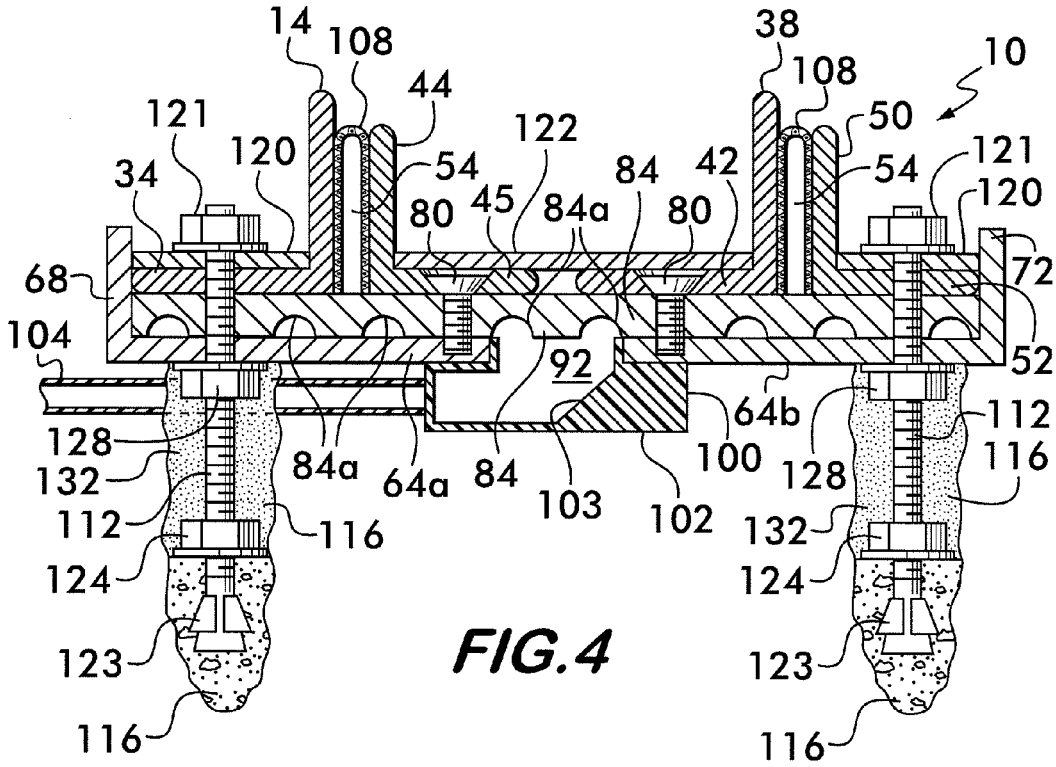

Referring now in detail to the various figures of the drawings wherein like reference characters refer to like parts, there is shown at 10 in FIGS. 1 through 4 the in-floor track assembly for sliding panels with a built-in drainage system of the present invention. As best shown in FIGS. 3 and 4, a track 14 extends upwardly and slightly above a top surface 18 of a finished floor 22 for engaging the undercarriage wheels 26 of a panel 30 and supporting the panel 30 while it is in motion, such as in rectilinear motion, on track 14. As shown in FIGS. 1, 3, and 4, the track 14 is a narrow elongated shape and is oriented upright and is formed of a narrow-gauge metal plate. The track 14 is affixed to or integral with a laterally extending base portion 34. Together, the track 14 and the laterally extending base portion 34 form a reverse "L" shape as shown in the drawings. The track 14 includes a shaped, e.g., rounded, top surface to provide smooth engagement with the wheels 26 that extend downwardly from the bottom of panel 30. The panel 30 may be formed of metal or wood construction and may include panel inserts of glass or wood, and are generally quite heavy. It is preferred that the track 14 be extruded, such as from aluminum or other extrudable metal, and be formed as a single piece with the base portion 34.

As best shown in FIGS. 3 and 4, a second track 38 runs parallel to and in closely spaced-apart relation to track 14. Like track 14, the second track 38 extends upwardly and slightly above a top surface 18 of a finished floor 22 for engaging the undercarriage wheels 26 of a second panel 36 and supporting the panel 36 while it is in motion, such as in rectilinear motion, on track 38. The second track 38 is affixed to or integral with a laterally extending base portion 42. Together, the track 38 and the laterally extending base portion 42 form a reverse "L" shape as shown in the drawings. In this manner, both panels 30 and 36 are slideable along the length of the track assembly 10 for reciprocal lateral movement relative to each other. Such sliding panels are particularly utilizable in residential dwellings and they are commonly used to provide egress to a deck, patio, etc. However, such sliding panels could also be utilizable in commercial applications. Alternatively, one of the panels may be fixed in place (not arranged for motion) and the other arranged for reciprocal lateral movement with respect to the fixed panel. Also, notwithstanding the fact that only two tracks 14 and 38 are illustrated in the drawings for supporting two panels, it should be understood that the present invention is not limited to two-track track assembly. To the contrary, the invention also contemplates a track assembly comprising three or more tracks arranged in parallel spaced-apart relation to each other for support of one or more fixed or moving panels for reciprocal lateral movement relative to each other.

Referring again to FIGS. 1, 3 and 4, an upright splash guard 44 is provided that corresponds to the narrow track 14 and a second upright splash guard 50 is provided that corresponds to narrow track 38. Each splash guard 44, 50 is parallel to its corresponding narrow track 14, 38 and is spaced slightly apart therefrom a distance sufficient to capture moisture either dripping or running off panels 30 and 36, or running across finished floor top surface 18 and over the top of track 14, 38 from the exterior area toward the interior area. The splash guard 44 and 50 forms with each track 14 and 38 a narrow drainage passageway 54 (FIG. 4) for allowing passage of moisture from the exterior or the bottom of each panel 30 and 36 and into a U-shaped drainage pan 60 assembly (FIG. 1) that includes separate floor sections 64*a* and 64*b*, an exterior sidewall 68 and an interior sidewall 72. As best illustrated in FIGS. 1 and 4, the floor sections 64*a* and 64*b* are two pieces held in a spaced-apart relationship to establish a gap 92 therebetween.

As best shown in FIGS. 1, 2 and 4, a plurality of spaced apart ribs 84 extend laterally across the separate floor sections 64*a* and 64*b* and include suitable through openings for securement to maintain the floor sections in the spaced-apart relationship. Each rib 84 includes a plurality of suitably shaped, e.g., semi-circular, drainage openings 84*a* that are spaced from each other a predetermined distance along the length of each rib 84. The drainage openings 84*a* serve to evenly distribute moisture flowing from the drainage passageway 54 into the U-shaped drainage pan 60 and across the floor sections 64*a* and 64*b*. Thereafter, moisture flows across the drainage pan floor sections 64*a* and 64*b* and into the gap 92 between the drainage pan floor sections 64*a* and 64*b*. The gap 92 extends the length of the drainage pan 60.

When used herein, the term "moisture" means rain, sleet, snow, and water splashed from swimming pools, hoses and the like. As shown in these figures, the tracks 14, 38 and corresponding splash guards 44, 50 are both upright, elongated, narrow-gauge plates that are separate from each other. In addition, it is preferred that each splash guard 44, 50 terminates or "tops" at finished floor top surface 18 so that the entire assembly is at or below top surface 18, except for a slight upward protrusion of the top surface of the tracks 14, 38 and thus forms a very smooth, uninterrupted top floor surface 18. It is preferred that the tracks be extruded as pieces separate from the splash guards so moisture can run freely through the drainage passageway 54.

In some instances, the splash guards 44, 50 and drainage passageways 54 may be located on the exterior side of the tracks 14, 38, as opposed to the interior side of the tracks as shown in FIGS. 1-4. However, it is preferred that the splash guards 44, 50 and drainage passageways 54 be located on the interior side of the assembly 10.

As best shown in FIG. 4, track 14 is rigidly mounted to the drainage pan exterior wall 68 by securement of its laterally extending base portion 34 thereto by any suitable method, e.g., welding. Splash guard 44 includes a laterally extending base portion 45. The base portion 45 includes a plurality of through openings, preferably round and spaced from each other by a predetermined distance, to enable securement of the splash guard 44 to corresponding through openings in the ribs 84 and drainage pan floor section 64*a* by any suitable means, e.g., screws 80. Preferably, the screws 80 are provided with flat heats and conical sides so they lie flush with the top surface of the laterally extending base portion 45. Similarly, track 38 includes a laterally extending base portion 42 to enable securement of the track to the ribs 84 and drainage pan floor section 64*b* by suitable means, e.g., screws 80. Corresponding splash guard 50 includes a laterally extending base portion 52 for securement to the drainage pan interior wall 72 by any suitable means, e.g., welding. During fabrication of the track assembly 10, the track 14 and splash guard 50 may be welded to the exterior and interior walls 68, 72 of the drainage pan 60 through their respective laterally extending base portions 34, 52 to create a unitary weldment. Thereafter, the splash guard 44 and track 38 may be secured to the ribs 84 and drainage pan floor sections 64*a* and 64*b* by the previously described suitable securement means.

A catch basin 100 is arranged to fit within the elongated gap 92 and is provided to collect moisture that passes through the gap 92. The catch basin 100 extends the length of the track assembly 10 and may be formed of any suitable material, e.g., a plastic such as polyvinyl chloride (PVC), polyvinylidene chloride, polyethylene, and the like, or other plastics that can be easily injection molded to reduce the cost of production. The catch basin 100 includes an open top cavity and a closed floor 102 for containing moisture. The floor 102 includes a sloped surface 103 to direct moisture collected therein toward one or more return or drainage hoses or tubes 104 connected to the side of the catch basin 100. The drainage tubes 104 draw off moisture from the catch basin 100 and return the moisture to the exterior.

Referring now to FIG. 4, a filter 108 is located in the drainage passageway 54 for preventing the ingress of debris. As shown in FIGS. 1, 3 and 4, the filter 108 may take the form of a strip of highly reticulated plastic foam cut and inserted into the drainage passageway 54. Not only does the filter 108 prevent the ingress of debris while also not interfering with the collection of moisture, it also is easily removed so that it can be renewed without significant cost or effort.

Referring now to FIGS. 3 and 4, as previously mentioned, the track assembly 10 is prefabricated away from the installation site. To install the track assembly 10 on a surface wherein the panels 30 and 36 are to slide, holes are first drilled through a cement subfloor 116. Wedge anchors 123 (FIG. 4) or other suitable hardware for fastening into concrete are hammered into the holes and anchored into position using supplied nuts and washers 124 (FIG. 4). Thereafter, additional suitable hardware 128 (FIG. 4), e.g., nuts and washers, is used to assist in properly locating and leveling the track assembly 10 in place in ways that are known in the art. Thereafter, a suitable concrete material 132 (FIG. 4) is poured under the track assembly 10 to fill in the space between the track assembly 10 and the cement subfloor 116.

Referring now to FIG. 4, a plate 120 extending the length of the track assembly is thereafter secured over the base portion 34 of track 14 and base portion 52 of splash guard 50 utilizing suitable securement hardware 121. Likewise, a single a plate 122 is secured over both base portions 45 and 42 of splash guard 44 and track 38, respectively, using suitable hardware. The plates 120 and 122 are provided to prevent the uncured concrete material 132 encasing the track assembly 10 from seeping into the track assembly 10 during assembly. Additional concrete material 132 is added in preparation of the laying of final or finished floor 22 that hides the track assembly 10 from view except for a small upper portion of tracks 14 and 38 and the very top of splash guards 44 and 50. The drainage hoses or tubes 104 pass through holes in the finished floor 22 or cement subfloor 116, preferably to the exterior for removing the collected moisture from the tracks 14 and 38.

It is understood that the track assembly and its constituent parts described herein is an exemplary indication of a preferred embodiment of the invention, and is given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof.

The invention claimed is:

1. An in floor track assembly with a built-in drainage system for sliding panels comprising:

a. a drainage pan having a floor and walls extending upwardly from said floor on opposite ends thereof;

b. a first track extending laterally from a wall of said drainage pan and positioned in spaced-apart relation with said drainage pan floor, said first track including an upstanding portion that extends upwardly and slightly above a finished floor level, said first track arranged to engage wheels of a vertically-oriented panel and support motion of said panel along said first track to divide an area about said first track into an exterior section and an interior section;

c. a first splashguard secured in spaced-apart relation with said drainage pan floor and including an upright portion located parallel to and spaced slightly apart from said first track in said interior section of said area, and topping at the level of the finished floor, said first splashguard forming a drainage passageway with said first track for permitting moisture to be directed therethrough to said drainage pan;

d. a catch basin mounted under said drainage pan and in communication with said drainage pan to collect moisture from an opening in said drainage pan;

e. drainage means for drawing off the moisture from said drainage pan and returning it to the exterior section; and, f. a second track secured in spaced-apart relation to said drainage pan floor, said second track including an upstanding portion that extends upwardly and slightly above a finished floor level, and a second splashguard extending laterally from a wall of said drainage pan and positioned in spaced-apart relation with said drainage pan floor, said second splashguard including an upright portion located parallel to and spaced slightly apart from said second track and forming a second drainage passageway with said second track, said drainage pan receiving moisture from all drainage passageways, wherein said first track is welded to said drainage pan wall, said first splashguard is secured to said drainage pan floor by securement means, said second track is secured to said drainage pan floor by securement means, and said second splashguard is welded to said drainage pan wall.

2. The in-floor track assembly with a built-in drainage system for sliding panels of claim 1, wherein said securement means includes screws.

* * * * *